US005483956A

United States Patent [19]

Shapiro

[11] Patent Number: 5,483,956

[45] Date of Patent: Jan. 16, 1996

[54] COMBINATION FIRE EMERGENCY NIGHT LIGHT AND SMOKE INHALATION PREVENTION ESCAPE MASK

[76] Inventor: Buddy R. Shapiro, 64 Bleecker St., New York, N.Y. 10012

[21] Appl. No.: 391,513

[22] Filed: Feb. 21, 1995

[51] Int. Cl.[6] ..... A62B 18/00

[52] U.S. Cl. ..... 128/206.27; 128/200.24; 128/206.21; 2/422; 2/7

[58] Field of Search ..... 128/200.24, 201.22, 128/201.23, 201.24, 201.25, 201.26, 202.13, 202.14, 202.15, 202.16, 202.17, 202.18, 202.19, 202.21, 202.22, 202.26, 202.27, 204.18, 205.26, 205.27, 205.28, 205.29, 206.27, 206.21; 2/422, 7

[56] References Cited

U.S. PATENT DOCUMENTS

| | | | |
|---|---|---|---|
| 1,079,251 | 11/1931 | Macrini | 128/201.23 |
| 2,262,522 | 11/1941 | Yant et al. | 128/201.23 |
| 3,895,625 | 7/1975 | Delest | 128/292.26 |
| 4,231,118 | 11/1980 | Nokagawa | 128/201.25 |
| 4,437,568 | 3/1984 | Hamblin | 206/223 |
| 4,467,795 | 8/1984 | Eckstein | 128/201.25 |
| 5,309,571 | 5/1994 | Huang | 2/81 |
| 5,419,450 | 5/1995 | Guglielmelli et al. | 128/201.25 |

OTHER PUBLICATIONS

"The Sharper Image" Catalog: Jul., 1994.

*Primary Examiner*—Edgar S. Burr
*Assistant Examiner*—V. Srivastava
*Attorney, Agent, or Firm*—Richard C. Litman

[57] ABSTRACT

The present invention relates to fire and hazardous fume safety equipment. More specifically, the present invention relates to a combination lighted escape mask and night light container. The mask includes a fire protective enclosure which fits around the head of a wearer, a light mounted on the top of the mask, a visibly transparent visor, a breathing filter, and an elastic collar to form an air-tight seal about the wearer's head. The escape mask fits inside a container which includes a biased top and an external night light which functions as an opening mechanism for the biased top of the container. An electrical connector connects the container and mask to an electrical source to constantly charge the light on the mask and the night light on the container. Thus, a kit is provided for saving a life in the event of fire. The invention is mostly important in its use, in that the night light feature allows the container to be found even in otherwise total darkness and in thick smoke conditions, and also because it actually forces the user to bend completely down while donning the mask, where breathable air still will likely exist, especially in at least the early stages of a fire.

14 Claims, 2 Drawing Sheets

COMBINATION FIRE EMERGENCY NIGHT LIGHT AND SMOKE INHALATION PREVENTION ESCAPE MASK

BACKGROUND OF THE INVENTION

1. Field of the Invention

The present invention relates to fire and hazardous fume safety equipment. More specifically, the present invention relates to a combination lighted fire safety hood and night light container.

2. Description of the Prior Art

Personal fire protection gear has been in use for as long as there have been organized fire-fighting brigades. Such gear includes the heavy, heat-resistant clothing, helmets, and self-contained breathing apparatus (including compressed air cylinders and regulators) worn by professional fire fighters. This type of fire, heat, and smoke protection, however, is not designed to be easily donned while actually in the midst of a fire situation (i.e., a fire fighter does not don his protective gear after he has already entered the conflagration, but rather in the safety of the fire-house). In fact, professional fire-fighting gear is very cumbersome and difficult to don quickly.

The primary reason for the bulky and cumbersome construction of professional fire-fighting protective clothing is because such gear is designed to withstand prolonged exposure to high heat and flames in order to allow the wearer to battle a blaze. On the other hand, the instant invention is directed primarily to consumer usage, it being further recognized that smoke inhalation is the leading cause of death and injury to fire victims. Further in contrast, the present invention is drawn to a combination night light and escape mask which is designed to be easily and quickly donned in the midst of a fire so as to allow the wearer to exit a burning structure quickly and safely. The night light is visible even through smoke so as to guide the user to the container housing an escape mask, which is equipped with another light to help the user find his or her way out into safety.

The need for such a device is especially acute during the evening hours. Few experiences are more frightening, or more dangerous, than to awaken in the midst of a house fire. With the thought processes still sluggish and groggy from sleep, a person in such a situation has only moments in which to gain safety or risk being overcome by smoke. Conventional fire-protective clothing is simply too cumbersome to be safely donned at such a moment. Of primary importance in such a situation is that the person quickly locate and don the protective gear, and exit the structure. However, the odds of finding one's way to a closet, locating the appropriate fire-protective clothing, putting the clothing on, and safely exiting the burning structure, all the while in the darkness of night and in the midst of choking and impenetrable smoke, are very small. In such a situation, time is absolutely of the essence and it is of great importance that one keep his or her head down as low as possible, where breathable air likely remains. If one simply stands erect to don a jacket under such conditions, he risks being overcome by smoke inhalation.

Several types of personal fire-resistant head protectors and related devices are described in the patent literature. For instance, U.S. Pat. No. 3,895,625, issued Jul. 22, 1975, to R. Delest, describes a head protection enclosure including a transparent housing which can be placed about the head of a wearer. Within the enclosure is an oxygen generation means, and a means to fix carbonic anhydride. In use, the device is folded and sealed such that a vacuum is formed within the enclosure. When the seal is released, incoming air expands the enclosure, and the oxygen generation means is automatically activated. The user then places the enclosure over his head, and a seal is formed about the wearer's neck so as to preclude ambient air from entering the enclosure. Within the enclosure, the oxygen exhaled in the wearer's breath is regenerated by the oxygen generation means, while the carbonic anhydride from the wearer's breath is fixed in a non-gaseous form. The wearer now has a certain period of time in which he is protected from smoke and other noxious fumes.

U.S. Pat. No. 4,231,118, issued Nov. 4, 1980, to Y. Nokagawa, describes a similar fire-protective head enclosure. Rather than regenerating oxygen from wearer's breath, the Nokagawa device includes a poison-fixing, heat-resistive filter which allows passage of ambient air into the head enclosure. The main enclosure is formed from non-flammable polyvinyl chloride (PVC) composite laminate sheets, and includes a transparent PVC view screen.

An emergency fire and smoke safety kit is described in U.S. Pat. No. 4,437,568, issued Mar. 20, 1984, to A. Hamblin. Unlike the references discussed above, which describes fire-resistant head protectors, this reference is drawn to a kit for fighting small fires, and includes first aid items, emergency clothes, and breathing apparatus. All of these items are contained in a roughly rectangular box having a hinged front. A fire extinguisher is mounted to the front of the box for easy access. Unlike the present invention, this device contemplates that the user will remain, at least for a short period, within the fire zone to battle the fire. The present invention, in contrast, functions to protect the wearer for a period of time of sufficient length to exit a burning building.

U.S. Pat. No. 5,309,571, issued May 10, 1994, to M. Huang, describes a fire protection suit which includes a face mask, lamp, air tank or gas filter, and a battery power supply. The device includes a body portion and sleeves. In storage, the device is rolled up inside out. When needed, the head enclosure portion is placed over the wearer's head, and the remainder of the suit allowed to unroll ever the wearer's body. The hands are then inserted into sleeves, and the lighting means and the air tank activated. The suit includes pockets for storing valuables, and is specifically designed to allow the wearer to function as a fire fighter.

A commercial catalog from "The Sharper Image", dated Jul. 1994, offers for sale a fake alarm system which consists solely of a very bright, blinking light-emitting diode (LED). The LED is mounted to a window of a building structure, in plain sight to potential burglar, o discourage the burglar from attempting a forced entry into the structure.

None of the above references, taken alone, or in any combination, is seen as describing the presently claimed beacon light and lighted escape mask.

SUMMARY OF THE INVENTION

The present invention relates to a combination night light and smoke inhalation prevention escape mask to protect a wearer for a sufficiently long period of time to enable the wearer to move to a safe area. The invention includes an escape mask having a fire-protective enclosure which includes a visibly transparent visor, an air filtration unit, and an elastically-deformable collar. Attached to the escape mask is an automatically activated light to provide the wearer illumination necessary to safely move about, and a compact, thermal blanket which may be deployed later to shelter the wearer once he or she has reached a safe area.

The escape mask functions in combination with a storage container which includes a night light, essentially also functioning as a beacon, to guide a user to the container. In storage, the escape mask is releaseably mounted to an orientation assembly located within the container. The orientation assembly positions the mask in the proper orientation for quick and easy donning by the wearer when the container is opened. Specifically, the orientation assembly forces the user to bend low toward a floor surface or the ground, where air is still relatively breathable, especially in the early stages of a fire.

The container includes a movable top which is biased towards an open position. With the escape mask releaseably fixed to the orientation assembly, the top is forced into a closed position, and held in place by a releaseable latch. To release the latch, and thereby allow the top to spring into the open position, a user depresses a lighted night light located on the top of the container. The night light functions as a beacon to both lead a user to the container and as the latch release mechanism.

In this manner, a user need not waste precious time fumbling about in the dark, searching for the fire protection mask. The preferred location for the combination fire emergency night light and escape mask would be on a floor, near to a bed. If the user should awaken in a fire situation, the location of the night light is readily ascertainable, even in a thick smoke. Because the night light is located on the floor, the user, frightened because of the fire, is naturally encouraged to remain low to the floor as he reaches for the night light. This unique feature affords more time to the wearer because more breathable air is located closer to the floor. Upon reaching the light, the user need only press upon the night light. The top of the container will spring open, and the escape mask can be quickly donned. The entire process of opening the container and donning the mask can be accomplished in less than three seconds.

The combination night light and escape mask includes an electrical connection to connect the container and the mask stored within to a source of electricity. Both the night light and the light which is mounted to the escape mask may include chargeable batteries or accumulators, which will be continually recharged by this connection. This ensures that both the night light and the mask light function properly in the event that the electricity source is adversely affected by the fire, which often is the case, or is in some other way disabled.

In view of the above discussion, it is an object of this invention to provide a protective head enclosure including lighting means and breath filtration means which can be donned very quickly with a minimum number of movements.

It is a further object of the present invention to provide a combination of a carrying case including a night light, inside which is stored a protective head enclosure to be worn in the event of a fire.

Another object of the present invention is to provide a combination night light and lighted escape mask in which the night light, and the light on the escape mask are continually recharged via a connection to an electrical power source.

Yet another object of the present invention is to provide a container having a night light thereon and containing a fire protection mask, in which the night light also functions as a release mechanism to open the container.

Still another object of the present invention is to provide a container having a night light in which, upon opening the container, a mechanism orients a fire escape mask in an orientation conducive to rapid donning of the mask, while requiring the user to bend down low and without forcing or even permitting the user to stand upright.

A further object of the present invention is to provide a combination fire escape mask which includes a fire protective head enclosure, a transparent visor, respirator and air filtration means, lighting means, and a protective blanket which may be deployed by a user to shelter himself once he has safely exited the structure.

These and other objects of the presently claimed combination fire emergency beacon light and escape mask will become clear upon a complete reading of the "Detailed Description", below.

DETAILED DESCRIPTION OF THE PREFERRED EMBODIMENT

Figure 1:
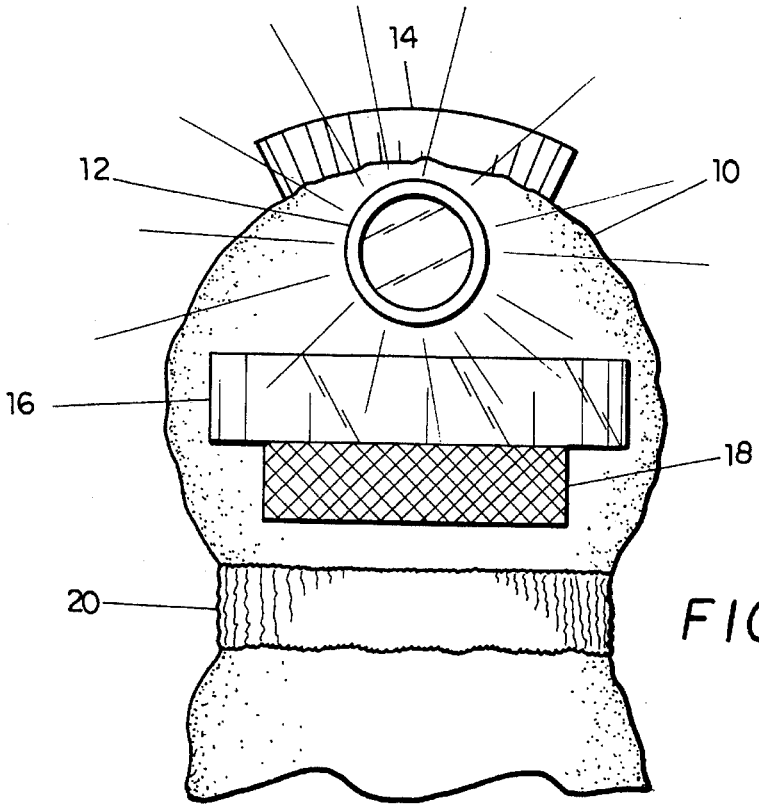
FIG. 1 is a front elevational view of an escape mask according to the present invention.

Reference is made herein to the attached drawing figures. Like reference numerals are used throughout the various drawings to designate like elements of the claimed invention.

Figure 2:
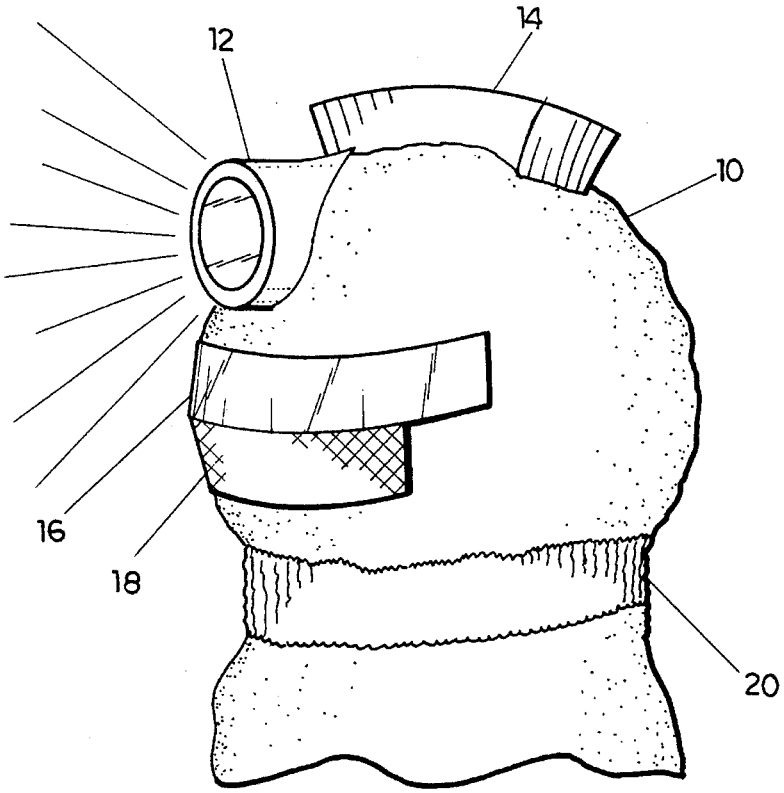
FIG. 2 is a perspective view of the escape mask shown in FIG. 1.

FIGS. 1 and 2 are a front elevational view and perspective view, respectively, of a fire protection head enclosure according to the present invention. Included is a fire-protective enclosure 10, which is capable of fitting about the head of a user. A visibly-transparent visor 16 is positioned such that the user can clearly see when wearing the enclosure. An air filtration unit 18 defines an air passage from the space within the enclosure to the ambient environment, and filters contaminants from the air which the user breathes.

An elastically-deformable collar 20 is integral with the fire-protective enclosure 10. The collar is capable of forming an air-tight seal about the neck and shoulders area of the user to preclude unfiltered air from entering the space within the enclosure.

A night light 12 is attached to an exterior surface of the fire-protective enclosure to provide guide lighting for the user so that he or she may find the enclosure, even in darkness and further in the presence of thick smoke. The light may be any type of conventional lighting means, including, but not limited to incandescent, fluorescent, and halogen lamps. The light may include a focusing lens to provide a tightly focused beam of light, or a more diffuse lighting pattern. The light 12 may also optionally be powered by portable rechargeable batteries. Such batteries may include electrical connectors capable of connecting batteries to a permanent electricity source. In this manner, when the enclosure is not in use, the batteries may be connected to the permanent electrical source and be continually recharged.

A very light weight, thermal blanket 14 may be releaseably folded and attached to the exterior surface of the fire-protective enclosure 10. The blanket may be manufactured from any number of commercially available, and well known thermal materials. In use, the blanket functions simply to protect the wearer from the elements once he or she has gained safety.

The filtration unit 18 may be capable of physically and chemically filtering contaminants from air passing therethrough. The filtration unit includes physical filtration means capable of removing particulate matter from the air which enters the filtration unit. Such physical filtration means include woven and non-woven fiber mats, open-celled foams, particulate carbon, and the like. A wide range of such particulate matter filters are commercially available and may be utilized based upon the size of the particulate matter which is to be filtered from the incoming air.

The filtering unit 18 may also include chemical filtering means for neutralizing hazardous or toxic fumes, such as carbon monoxide. By the term neutralizing is meant rendering such hazardous or toxic materials non-hazardous or non-toxic, or transforming such fumes into a generally safe form. Such chemical filtering means may include one or more of the following: zeolites, catalysts, anion exchange resins, activated carbon, and the like. Additionally, the entire filter unit 18 may be removable from the enclosure to facilitate the insertion of new or different types of filters.

Figure 3:
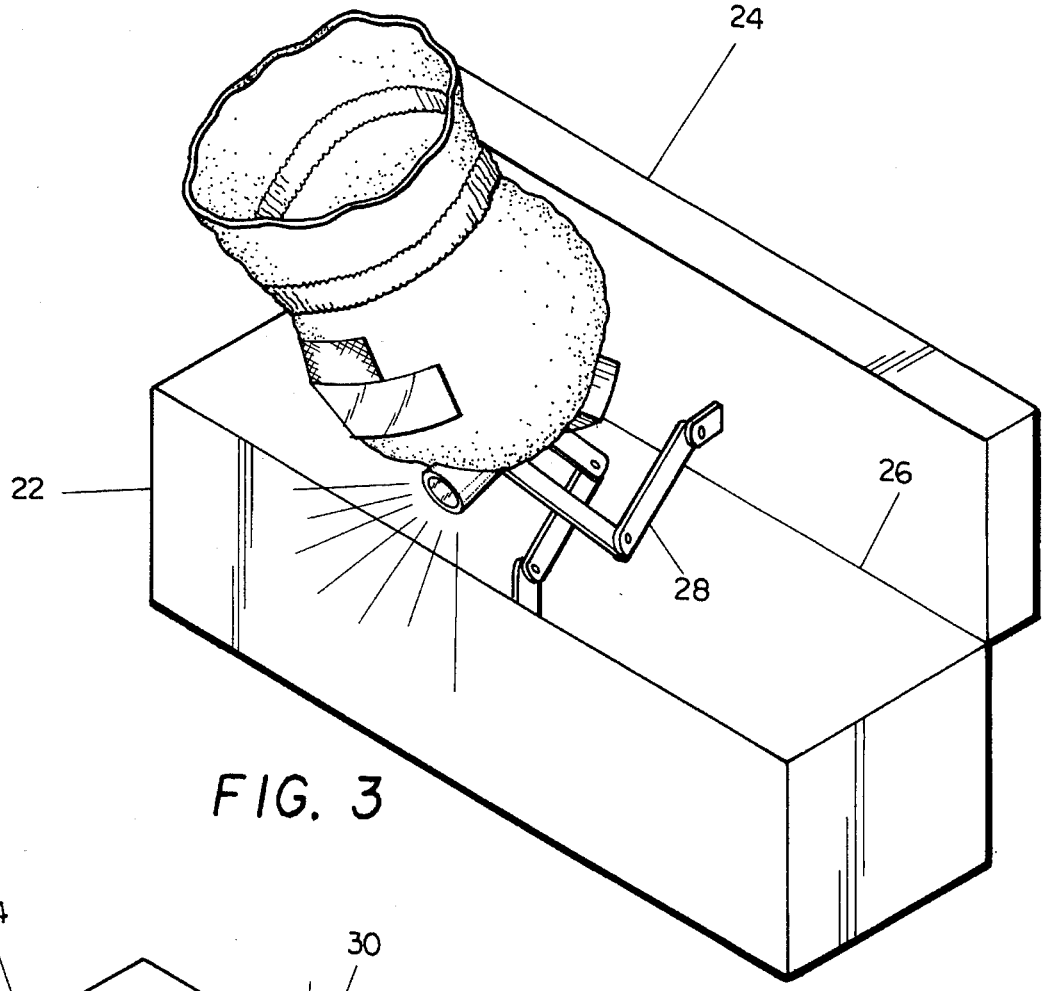
FIG. 3 is a perspective view of the combination night light and escape mask, with the container in the open position.
Figure 4:
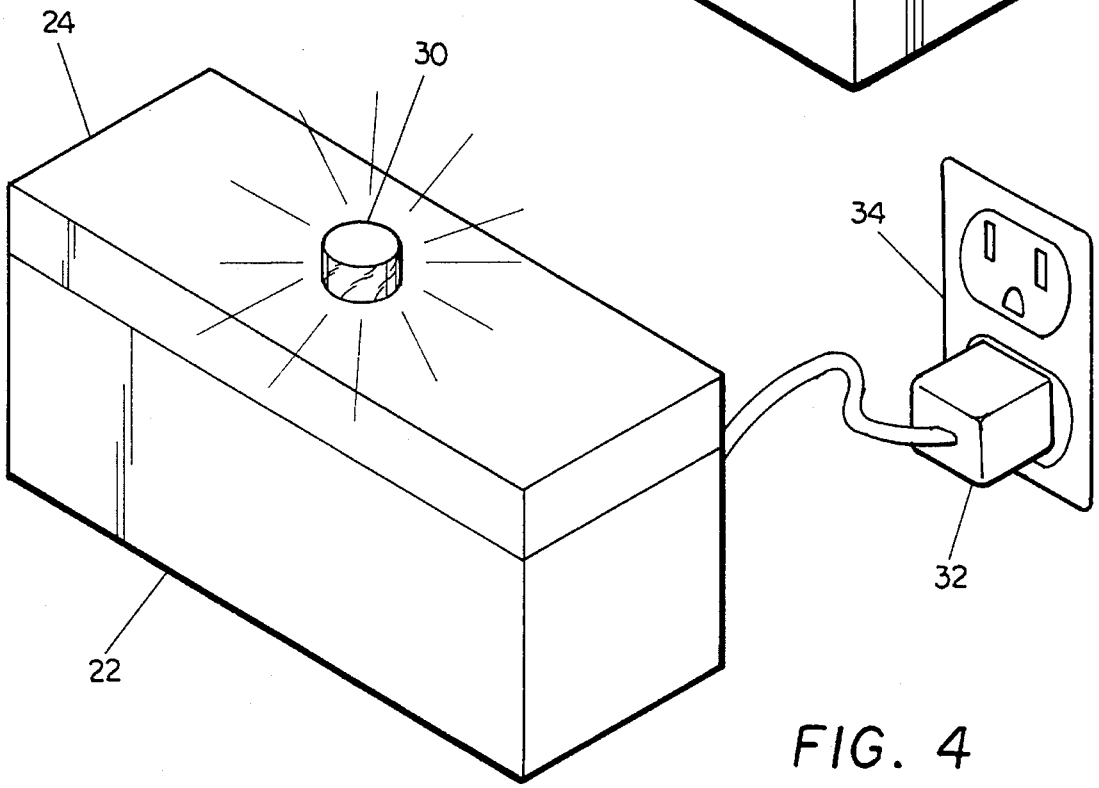
FIG. 4 is a perspective view of the container in the closed position showing the night light/release mechanism.

FIGS. 3 and 4 show a container housing 22 and top 24, in which the fire-protective enclosure is stored when not in use. As is clearly shown in these two figures, the top 24 is movable between an open position (FIG. 3) and a closed position (FIG. 4).

Preferably, the top 24 is pivotally mounted to the housing 22 via biasing means 26. The biasing means bias top toward the open position shown in FIG. 3. When in the closed position, a release button and latch mechanism 30 releaseably latches the top in place against the force of the biasing means 26. The latch mechanism 30 also doubles as an externally-mounted night light. The latch mechanism/night light is connected to a permanent electrical source 34 via electrical connector 32. Preferably, rechargeable batteries are attached to the release button - night light - latch mechanism 30, the batteries being continually recharged when not in use. When the top 24 is in the closed position, the latch mechanism and night light is, of course, illuminated to guide a potential user to the container. Depressing the night light button releases the latch mechanism, and the top 24 pops into the open position via the action of the biasing means 26.

When the top 24 is in the opened position, an orientation assembly 28 located within the container housing orients the fire-protective head enclosure in the proper position to aid quick donning by a user. The orientation assembly is releaseably attachable to the fire protection head enclosure via any known means, most preferably Velcro-type hook and loop closures.

An important feature of the invention is that it readily lends itself to periodic fire drills without in any way compromising the utility of the invention in a fire emergency. All family members can practice finding, opening and donning so that, should a fire occur, all are trained not only to bend low to don the enclosure 10 but to remain low during escape so that the inhaling of smoke laden and possibly superheated air in a real fire is avoided. Often, superheated air, which if inhaled causes fatal results, remains above the floor or ground while a layer of relatively cooler and likely still breathable air remains close to the floor or ground, at least during the early stages of a fire when safe escape is possible.

As shown in FIG. 3, the orientation assembly 28 includes two jointed scissors members, each of which have a first end and a second end and a movable joint located therebetween. The first end of one of the scissors members is fixedly attached to the container housing 22. The first end of the other scissors member is fixedly attached to the top 24. Both of the second ends of the two scissors members define an attachment point where the orientation assembly is releaseably attachable to a top portion of fire-protective enclosure.

In the event of a fire, a user need only search for the night light/latch mechanism. Even if the electricity supply has been interrupted, the batteries within the container will keep the night light illuminated. Upon depressing the night light, the top to the container will pop open, thereby presenting the head enclosure in the proper orientation to be donned by the user. The user can then quickly and safely exit the structure.

It is to be understood that the invention is not limited in any manner to the embodiment described above, but includes any and all embodiments encompassed by the following claims.

I claim:

1. In combination, a fire protection head enclosure and lighted container therefore, said combination comprising:

a fire-protective enclosure capable of fitting about the head of a user, including a visibly-transparent visor through which the user can see, and an air filtration unit defining an air passage through said enclosure and capable of filtering contaminants from air passing therethrough, said enclosure releaseably attachable to an orientation assembly;

an elastically-deformable collar integral with said fire-protective enclosure capable of forming an air-tight seal about the neck and shoulders area of the user;

a light attached to an exterior surface of said fire-protective enclosure; and a blanket releaseably folded and attached to said exterior surface of said fire-protective enclosure; and a container housing and top therefor, said top movable between an open position and a closed position;

biasing means for biasing said top toward said open position;

a latch mechanism for releaseably latching said top in said closed position, said latch mechanism including an externally-mounted, illuminated release button; and an orientation assembly located within said container housing, said orientation assembly releaseably attachable to said fire protection head enclosure.

2. The combination according to claim 1, wherein said orientation assembly comprises two jointed scissors members, each of said scissors members having a first end and a second end and a movable joint located therebetween, one of said first ends fixedly attached to said container housing and the other of said first ends fixedly attached to said top, and both of said second ends releaseably attachable to a top portion of said fire-protective enclosure.

3. The combination according to claim 2, further comprising hook and loop-type closures for attaching said top portion of said fire-protective enclosure to said second ends of said scissors members.

4. The combination according to claim 1, wherein said air filtration unit includes physical filtration means for filtering particulate contaminants from air passing therethrough and chemical filtration means for chemically neutralizing chemical contaminants passing therethrough.

5. The combination according to claim 4, wherein said physical filtration means is selected from the group consisting of particulate carbon, woven fiber mats, non-woven fiber mats, open-celled blown foams, and combinations thereof.

6. The combination according to claim 4, wherein said chemical filtration means is selected from the group consisting of zeolites, catalysts, ion exchange resins, activated carbon, and combinations thereof.

7. The combination according to claim 1, further comprising means for enabling ready removal of said filtration unit from said fire-protective enclosure.

8. In combination, a fire protection head enclosure and lighted container therefore, said combination comprising:

a fire-protective enclosure capable of fitting about the head of a user, including a visibly-transparent visor through which the user can see, and an air filtration unit defining an air passage through said enclosure and capable of filtering contaminants from air passing therethrough, said enclosure releaseably attachable to an orientation assembly;

an elastically-deformable collar integral with said fire-protective enclosure capable of forming an air-tight seal about the neck and shoulders area of the user;

a light attached to an exterior surface of said fire-protective enclosure, said light including a portable rechargeable battery and electrical connectors capable of connecting said portable rechargeable battery to a permanent electricity source; and a blanket releaseably folded and attached to said exterior surface of said fire-protective enclosure; and a container housing and top therefor, said top movable between an open position and a closed position;

biasing means for biasing said top toward said open position;

a latch mechanism for releaseably latching said top in said closed position, said latch mechanism including an externally-mounted, illuminated release button;

rechargeable batteries attached to said illuminated release button, and electrical connectors capable of connecting said rechargeable batteries to a permanent electricity source; and an orientation assembly located within said container housing, said orientation assembly releaseably attachable to said fire protection head enclosure.

9. The combination according to claim 8, wherein said orientation assembly comprises two jointed scissors members, each of said scissors members having a first end and a second end and a movable joint located therebetween, one of said first ends fixedly attached to said container housing and the other of said first ends fixedly attached to said top, and both of said second ends releaseably attachable to a top portion of said fire-protective enclosure.

10. The combination according to claim 9, further comprising hook and loop-type closures for attaching said top portion of said fire-protective enclosure to said second ends of said scissors members.

11. The combination according to claim 8, wherein said air filtration unit includes physical filtration means for filtering particulate contaminants from air passing therethrough and chemical filtration means for chemically neutralizing chemical contaminants passing therethrough.

12. The combination according to claim 11, wherein said physical filtration means is selected from the group consisting of particulate carbon, woven fiber mats, non-woven fiber mats, open-celled blown foams, and combinations thereof.

13. The combination according to claim 11, wherein said chemical filtration means is selected from the group consisting of zeolites, catalysts, ion exchange resins, activated carbon, and combinations thereof.

14. The combination according to claim 8, further comprising means for enabling ready removal of said filtration unit from said fire-protective enclosure.

* * * * *